United States Patent [19]

Tibolla

[11] 4,396,898

[45] Aug. 2, 1983

[54] LAMPHOLDER HAVING THERMAL PROTECTOR

[75] Inventor: Julius F. Tibolla, Yardley, Pa.

[73] Assignee: GTE Products Corporation, Stamford, Conn.

[21] Appl. No.: 362,186

[22] Filed: Mar. 26, 1982

[51] Int. Cl.[3] ..... H01H 61/01

[52] U.S. Cl. ..... 337/113; 337/269

[58] Field of Search ..... 337/112, 113, 186, 201, 337/208, 252

[56] References Cited

U.S. PATENT DOCUMENTS

| | | | |
|---|---|---|---|
| 1,683,992 | 9/1928 | Shoenberg et al. | 337/113 X |
| 2,016,244 | 10/1935 | Gregory | 337/113 X |
| 2,458,724 | 1/1949 | Parissi et al. | 337/113 X |
| 4,131,868 | 12/1978 | Dombrowski et al. | 337/113 |

*Primary Examiner*—George Harris

*Attorney, Agent, or Firm*—J. Stephen Yeo

[57] ABSTRACT

A lampholder includes a thermal protector for disconnecting the lamp from electrical power if the lampholder is overheated. The thermal protector is a packaged device and is held by a keeper. The keeper may be one piece with a contact to the lamp. Keepers for both glass and metal packaged thermal protectors are described.

8 Claims, 7 Drawing Figures

LAMPHOLDER HAVING THERMAL PROTECTOR

BACKGROUND OF THE INVENTION

This invention pertains to electrical lampholders of the socket type, and more particularly, is concerned with lampholders having over temperature protection.

Under a variety of circumstances, lamp heat can build up to excessive levels and damage nearby wiring and fixtures. In response to this danger, thermal protectors for incandescent lamps have been located in the electrical circuit upstream from the lamp. Unfortunately, in most installations, the protector is some distance away from the lamp, and does not react in direct response to lamp heat but to current and ambient temperature. This arrangement may respond to an overrated lamp being used, but would not respond rapidly, if at all, to heat build up due to mechanical causes such as poor air circulation.

U.S. Pat. No. 4,131,868, describes a lampholder containing a thermal protector to shut off current flow to the lamp when the lampholder is heated above a predetermined temperature. The thermal protector called for is not a packaged device but is assembled from separate pieces during manufacture of the lampholder.

This arrangement was an advance of the state of the art but can be improved upon. The protector has to be calibrated after manufacture of the lamp assembly which can be an awkward procedure. The protector's contacts are exposed and may spark when the protector is tripped. It would be advantageous to utilize a precalibrated shock resistant hermetically sealed protector which may be gas filled to ensure both maximum thermal transfer and arc suppression for greater contact life.

DESCRIPTION OF THE INVENTION

Figure 1:
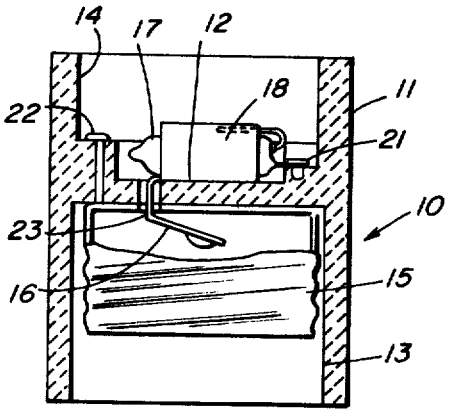
FIG. 1 is a cross sectional view of a lampholder embodying the invention.

Referring first to FIG. 1, there is seen a cross sectional view of a lampholder 10 embodying the invention. The lampholder includes a housing 11 made of insulating material such as high temperature plastic or ceramic. The housing is generally a hollow cylinder with a shelf 12, partitioning the interior of the cylinder into a socket section 13 for receiving a lamp base (not shown), and a wiring section 14 for enclosing connectors to the power source. A threaded shell 15 is arranged within the socket section 13 for making contact with the threaded terminal of the lamp base. A strip contact 16 is arranged on the shelf for making contact with the center terminal of the lamp base.

As a feature of the invention, a packaged thermal protector 17 is held in place within the wiring section 14 of the housing by a keeper 18 in electrical communication with strip contact 16. Preferably the keeper 18 and strip contact 16 are constituents of an integral whole, that is to say, they are formed as one piece, of spring metal. The strip contact 16 extends from the keeper 18 and passes through slot 23 provided for that purpose in the shelf 12 to the socket side of the shelf.

The protector 17 is a two terminal device and is arranged with one terminal coupled to the keeper 18 and the other coupled to the power source, forming a series circuit with a lamp in the socket.

A thermal protector functions as a normally closed switch and usually uses a bimetal blade which is prestressed to provide a snap action. The blade carries a silver contact normally in contact with a stationary silver contact. Leads run from the blade and stationary contact to outside the protector's package. If the bimetal blade reaches a present temperature, the blade snaps its contact away from the stationary contact, in effect opening the switch. The protector's rating is given as the ambient temperature at which the switch will open when there is no current flowing through it and is termed No Current Trip Temperature of NCT.

As a feature of the present invention the thermal protector is arranged proximate to the base of the lamp and is heated by the lamp, and, to a lesser degree, by the current flowing through the protector.

The protector has a selected NCT rating which is dependent upon the wattage of the lamp. A NCT rating of about 150° C. is typical.

Figure 3:
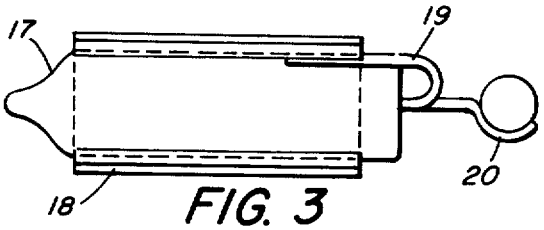
FIGS. 3, 4, and 5 are views of the glass packaged thermal protector and clip keeper of the first embodiment.
Figure 5:
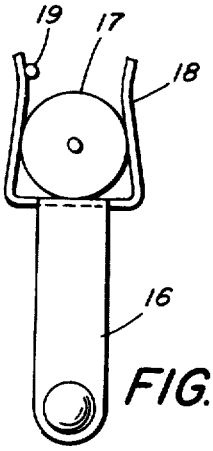
Figure 4:
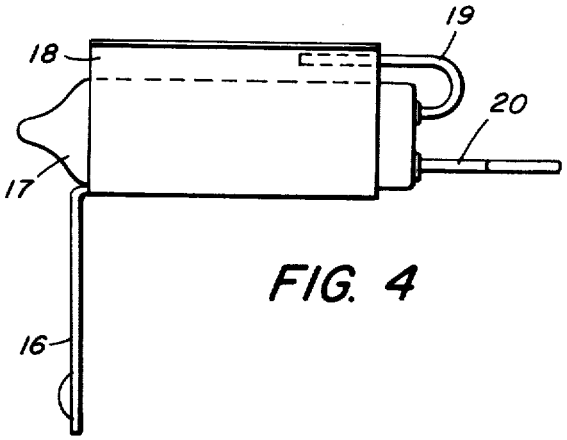

In the preferred embodiment of FIG. 1, the keeper is adapted to hold a packaged thermal protector of the type hermetically sealed in a small elongate glass envelope. This type of thermal protector has a faster thermal response than protectors enclosed by metal. As seen best in the views of FIGS. 3, 4, and 5, the keeper 18 is a clip sized to clasp and secure tightly the glass envelope 17. Suitable glass packaged thermal protectors are commercially available, as for example, members of the GTE Sylvania Series HSB. These protectors have a diameter of about 7.5 mm and are about 30 mm long.

Figure 2:
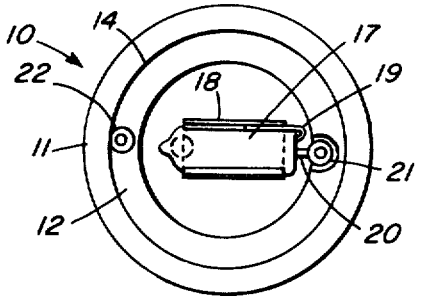
FIG. 2 is an end view of the holder of FIG. 1.

The protector has two wire leads (19, 20) extending from one end. One lead 19 is soldered or crimped to the clip 18 and the protector 17 is snapped into the clip 18. In use the remaining lead 20 is preferably coupled by solder terminal 21 to the hot wire of the electrical supply. The shell 15 is coupled to the ground wire by solder terminal 22 as seen in FIG. 2. The strip connector 16 extends from the clip 18 and passes through the slot 23 provided in the shelf 12 and is bent so that the clip 18 and strip connector 16 are approximately parallel to each other on opposite sides of the shelf 12 as seen in FIG. 1.

Figure 6:
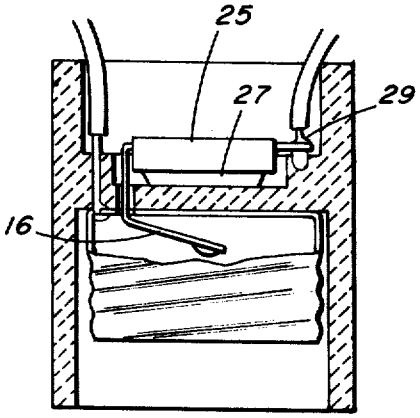
FIG. 6 is a cross section view of a lampholder which is a second embodiment of the invention.
Figure 7:
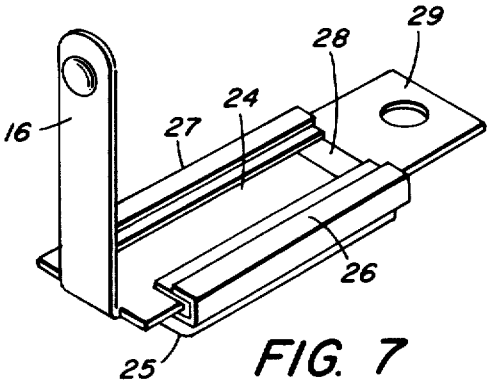
FIG. 7 is a metal packaged thermal protector and a prong keeper used in the second embodiment.

Another embodiment in the invention is shown in FIGS. 6 and 7. Here, the keeper is shaped as a prong 24, sized to accept a metal enclosed protector 25 such as one of the 7 mm series manufactured by Texas Instruments. This device has insulated hooks 26, 27 which allow the protector to grasp prong 24. This type of protector has a flat terminal 28 which contacts the prong 24. A second terminal 29 is coupled to the hot wire of the power supply.

While it is preferred the keeper and strip contact are one piece, the invention is not so limited. In keeping with the invention, the keeper and strip contact may be originally two pieces riveted together through the shelf.

Each of these embodiments function in the same manner. If the temperature of the lamp becomes excessive (perhaps due to poor circulation or wrong lamp rating) the thermal protector opens and extinguishes the lamp.

It will be appreciated that many modifications can be made within the scope of the invention. Therefore the specific embodiments described are considered as exemplary and do not limit the invention as defined by the following claims.

I claim:

1. An improved thermally protected lampholder of the type including a housing, said housing defining an interior and having a shelf partitioning said interior, a threaded shell arranged within said housing for making contact with the threaded terminal of a lamp, a strip contact arranged on said shelf to make contact with the center terminal of said lamp and a thermal protector coupled to said strip contact, wherein the improvement comprises:

said thermal protector is a packaged thermal protector; and a keeper proximate to said shelf and adapted to retain said packaged thermal protector, said keeper electrical coupled to said strip conductor.

2. The improved thermally protected lampholder of claim 1 wherein said keeper and said strip connectors are arranged on opposite sides of said shelf.

3. The improved thermally protected lampholder of claim 2 wherein said packaged thermal protector is enclosed by an elongated glass envelope and said keeper is a clip sized to clasp said glass envelope.

4. The improved thermally protected lampholder of claim 3 wherein said clip and said strip contact are one piece of spring metal.

5. The improved thermally protected lampholder of claim 3 or 4 wherein said packaged thermal protector has two leads, one of which is electrically connected to said clip.

6. The improved thermally protected lampholder of claim 2 wherein said packaged thermal protector is enclosed by a metal envelope having hooks and said keeper is a prong sized to be clasped by said hooks.

7. The improved thermal protected lampholder of claim 6 wherein said protector has a flat terminal in contact with said prong.

8. The improved thermally protected lampholder of claim 6 or 7 wherein said prong and said strip contact are one piece of spring metal.

* * * * *